US011906214B2

(12) United States Patent
Su et al.

(10) Patent No.: US 11,906,214 B2
(45) Date of Patent: Feb. 20, 2024

(54) COMPRESSOR COOLING

(71) Applicant: Emerson Climate Technologies GmbH, Berlin (DE)

(72) Inventors: Xiaogeng Su, Welkenraedt (BE); Jesus Nohales, Welkenraedt (BE); Linus Dellweg, Welkenraedt (BE); Marco Ruiz, Welkenraedt (BE)

(73) Assignee: Copeland Europe GmbH, Berlin (DE)

( * ) Notice: Subject to any disclaimer, the term of this patent is extended or adjusted under 35 U.S.C. 154(b) by 242 days.

(21) Appl. No.: 17/063,248

(22) Filed: Oct. 5, 2020

(65) Prior Publication Data

US 2021/0116154 A1 Apr. 22, 2021

(30) Foreign Application Priority Data

Oct. 21, 2019 (EP) ..... 19204296

(51) Int. Cl.
*F25B 31/00* (2006.01)
*F25B 41/40* (2021.01)

(52) U.S. Cl.
CPC ..... *F25B 31/006* (2013.01); *F25B 31/002* (2013.01); *F25B 41/40* (2021.01); *F25B 2400/07* (2013.01); *F25B 2500/16* (2013.01)

(58) Field of Classification Search
CPC ..... F25B 31/006; F25B 31/002; F25B 41/40; F25B 2400/07; F25B 2500/16
See application file for complete search history.

(56) References Cited

U.S. PATENT DOCUMENTS 3,191,403 A * 6/1965 Ladusaw ..... F25B 31/008 62/505
4,216,661 A 8/1980 Tojo et al.
(Continued)

FOREIGN PATENT DOCUMENTS

CN 1388346 A 1/2003
CN 102297132 A 12/2011
(Continued)

OTHER PUBLICATIONS

CA Search Report regarding European Patent Application No. 19204296.8, dated May 4, 2020.
(Continued)

*Primary Examiner* — David J Teitelbaum
(74) *Attorney, Agent, or Firm* — Harness, Dickey & Pierce, P.L.C.

(57) ABSTRACT

A compressor comprises a suction port configured to receive a refrigerant and means for compressing the refrigerant. The means for compressing forms at least one compression chamber, a discharge port configured for discharging the compressed refrigerant from the compressor, and a motor. The means for compressing comprises at least one opening for extracting a portion of the refrigerant from the at least one compression chamber and supplying the extracted portion of the refrigerant to the motor. A method comprises receiving a refrigerant at a suction port of the compressor, compressing the refrigerant in at least one compression chamber formed by a means for compressing of the compressor, discharging the refrigerant from the compressor at a discharge port of the compressor, and extracting a portion of the refrigerant from the at least one compression chamber and supplying the extracted portion of the refrigerant to a motor of the compressor.

20 Claims, 5 Drawing Sheets

(56) References Cited

U.S. PATENT DOCUMENTS

Figure 1:
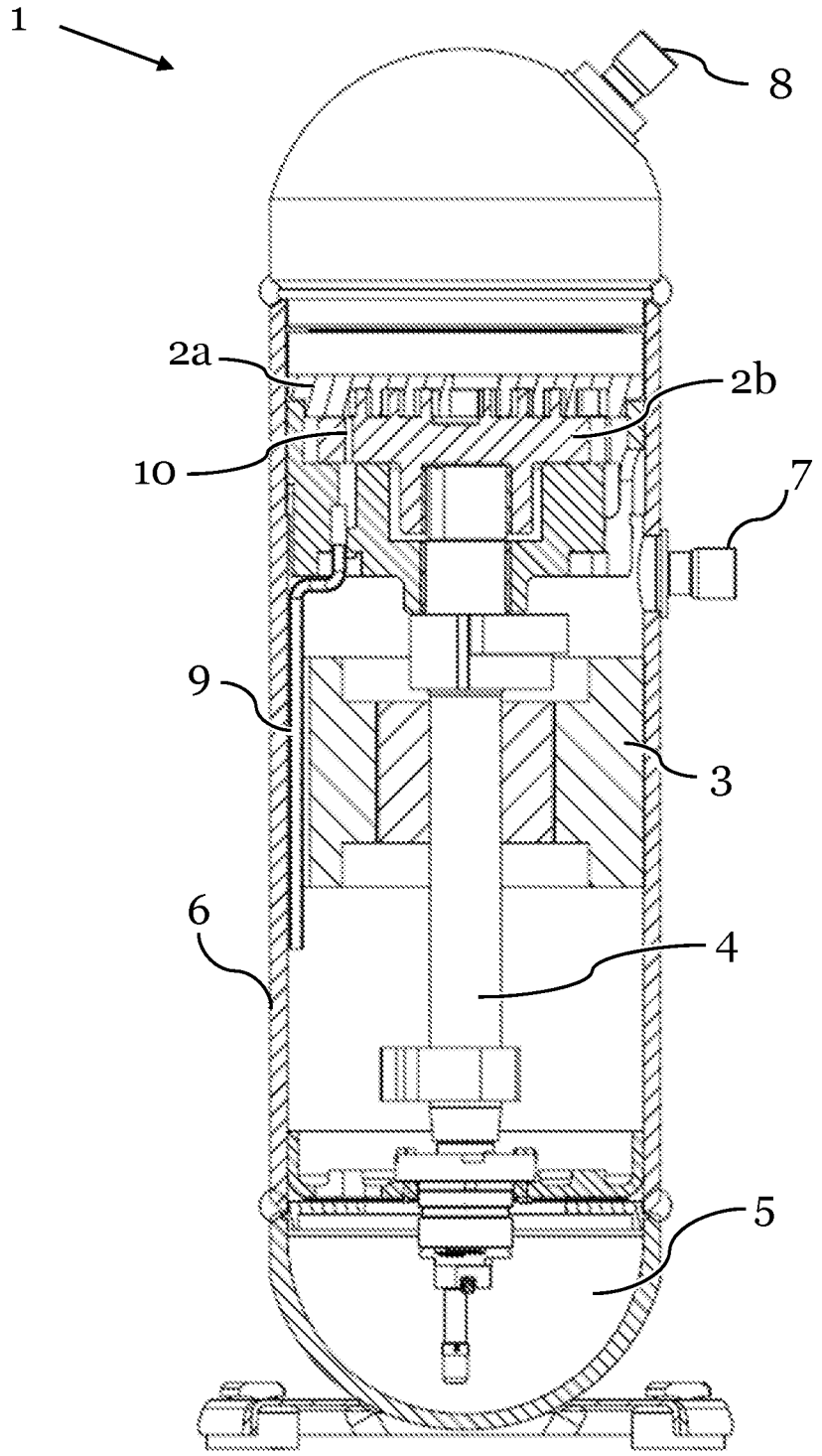

| | | | | |
|---|---|---|---|---|
| 4,343,599 | A * | 8/1982 | Kousokabe | F04C 29/023 418/55.6 |
| 4,365,941 | A * | 12/1982 | Tojo | F25B 31/008 417/372 |
| 2001/0006604 | A1 * | 7/2001 | Choi | F04C 18/0269 418/55.3 |
| 2003/0156961 | A1 | 8/2003 | Iizuka | |
| 2003/0161743 | A1 | 8/2003 | Kimberlin et al. | |
| 2010/0129240 | A1 | 5/2010 | Shiibayashi et al. | |

FOREIGN PATENT DOCUMENTS

| | | | |
|---|---|---|---|
| CN | 102472528 | A | 5/2012 |
| CN | 104421151 | | 3/2015 |
| EP | 1260570 | A1 | 11/2002 |
| EP | 1270947 | A2 | 1/2003 |
| EP | 2784266 | A2 | 10/2014 |
| EP | 3043072 | A1 | 7/2016 |
| JP | H029979 | A | 1/1990 |

OTHER PUBLICATIONS

Office Action with Search Report issued in corresponding Chinese Application No. 202011117340.4 dated May 5, 2023.

* cited by examiner $t = 0$ $t = T$ $t = 2T$ $t = 3T$

COMPRESSOR COOLING

CROSS-REFERENCE TO RELATED APPLICATIONS

This application claims the benefit and priority of European Application No. 19204296.8, filed Oct. 21, 2019. The entire disclosure of the above application is incorporated herein by reference.

FIELD

The present disclosure relates to a compressor, in particular a scroll compressor having improved cooling, wherein such compressor could be used, for example, in refrigeration systems.

BACKGROUND AND SUMMARY

A compressor is an apparatus, which reduces the volume of a fluid by increasing the pressure of the fluid. In most common applications, the fluid is a gas.

The compressors are used, for example, in refrigeration systems. In a common refrigeration system, a refrigerant is circulated through a refrigeration cycle. Upon circulation, the refrigerant undergoes changes in thermodynamic properties in different parts of the refrigeration system and transports heat from one part of the refrigeration system to another part of the refrigeration system. The refrigerant is a fluid, i.e. a liquid or a vapor or gas. Examples of refrigerants may be artificial refrigerants like fluorocarbons. However, in recent applications, the use of carbon dioxide, $CO_2$, which is a non-artificial refrigerant, has become more and more important, because it is non-hazardous to the environment.

A compressor comprises at least a suction port, a discharge port, a means for compressing, and a motor. At the suction port, the compressor receives the fluid, which is to be compressed. In case the compressor is used in a refrigeration system, the fluid is a refrigerant. At the suction port, the fluid usually is in a gaseous or vapor state. The means for compressing is used for compressing the fluid from an initial pressure, for example, the pressure the fluid has at the suction port, to a desired discharge pressure. For example, the means for compressing may define a compression chamber, which is a closed volume, in which a portion of the refrigerant will be compressed. Afterwards, the compressed fluid is discharged at the discharge port. The operation of the compressor is actuated by the motor. In order to achieve this, the motor may be operatively coupled to the means for compressing. In most common compressors, the motor and the parts of the compression chamber are lubricated by a lubricant, for example an oil.

During operation, the compressor will heat up under load. On the one side, this is because of heat losses caused by the motor and the friction between the actuated parts of the compressor as well as the lubricant. On the other side, the compression of the refrigerant causes the temperature of the refrigerant to rise, which also affects the temperature of the parts, which are in contact to the refrigerant, for example, the means for compressing or the lubricant. If the temperature of the compressor will get too high, the operation of the compressor may be negatively affected. For example, the refrigerant may be discharged at a temperature, which is too high, or the efficiency of the compressor may be reduced. Further, it is also possible that parts of the compressor may be damaged, for example caused by increased friction as a result of disrupted lubricant supply.

Hence, there is a need in the art for improving cooling in a compressor.

The above-mentioned need for improved cooling in a compressor is fulfilled by the compressor with cooling according to the invention. Thereby, the invention uses the refrigerant, which is received from the compressor suction at a low temperature, for cooling.

A compressor according to the invention comprises a suction port, which is configured to receive a refrigerant, in particular, from a refrigeration cycle. The suction port may be connected to at least one other component of the refrigeration cycle, from which the suction port receives the refrigerant. In an example, the suction port may be connected to a heat accepting heat exchanger, which is sometimes referred to as evaporator. The connection may be a direct connection or an indirect connection. When the suction port is directly connected to the at least one other component of the refrigeration cycle, there is no other component between the suction port and the at least one other component. The connection may be realized, for example, by ease of a tube, a line, or a hose. In an indirect connection, an additional component may be connected between the suction port and the at least one other component.

Further, the compressor comprises a means for compressing, which is configured for compressing the refrigerant. The means for compressing preferably defines at least one compression chamber, in which the refrigerant will be compressed. For this purpose, the means for compressing may comprise at least one movable element. The movable element may be configured for changing the volume of the at least one compression chamber. Changing said volume may include increasing and/or reducing the volume. A reduction of the volume may cause a compression of the refrigerant inside the volume.

Further, the means for compressing preferably comprises at least one inlet configured for receiving the refrigerant and one outlet for ejecting at least a portion of the refrigerant after compression. The inlet of the means for compressing is in fluid communication with the suction port and is configured to receive the refrigerant, which enters the compressor at the suction port. The outlet of the means for compressing is in fluid communication with the discharge port and is configured to eject the compressed refrigerant from the means for compressing. The outlet may comprise a valve. Such a valve may prevent the ejected refrigerant from flowing back to the means for compressing.

During operation of the compressor, the motion of the at least one movable element causes at least a portion of the refrigerant to flow from the inlet of the means for compressing into the at least one compression chamber and causes compression of the refrigerant inside the at least one compression chamber. Further, the motion of the at least one movable element causes an ejection of at least a portion of the compressed refrigerant from the means for compressing via the outlet.

The compressor comprises a discharge port, which is configured for discharging at least a portion of the compressed refrigerant from the compressor. The discharge port is in fluid communication with the outlet of the means for compressing. Further, the discharge port may be connected to another component of the refrigeration cycle, for example a heat rejection heat exchanger. The connection may be a direct connection or an indirect connection. When the discharge port is connected to the at least one other component of the refrigeration cycle directly, there is no other component between the discharge port and the at least one other component. The connection may be realized, for example, by ease of a tube, a line, or a hose. In an indirect connection, an additional component may be connected between the discharge port and the at least one other component.

Further, the compressor comprises a motor. The motor may be used for actuating the compressor, in particular the means for compressing. For example, the motor may actuate the at least one movable element of the means for compressing.

According to the present invention, the means for compressing comprises an opening for extracting a portion of the refrigerant from the at least one compression chamber and supplying the extracted portion of the refrigerant to the motor. The supplying could be supported by various means. For example, the extracted portion of the refrigerant could be supplied to the motor by piping the extracted portion of the refrigerant to the location of the motor inside the compressor. The piping may achieve that the extracted portion of the refrigerant circulates around the motor.

The portion of the refrigerant may be extracted from the at least one compression chamber by pumping the portion of the refrigerant through the opening. Thereby, the pumping may be performed by the at least one movable element of the means for compressing. This has the advantage that no additional components, such as pumps, are needed for the cooling, which is provided by to the invention.

The opening for extracting the portion of the refrigerant may be located at any position inside the means for compressing, which is suitable for extracting the portion of the refrigerant. A suitable position may be any position at which the opening will be in fluid communication with the refrigerant for at least a portion of time. Hence, the portion of the refrigerant may be extracted at any time before or during the compression process, depending on the position of the opening.

In general, it may, however, be preferred to extract the portion of the refrigerant from the at least one compression chamber before the compression starts or at an early stage of the compression. The at least one compression chamber receives the refrigerant form the suction port of the compressor and will undergo changes in its volume, which will cause the refrigerant inside the at least one compression chamber to be compressed. The portion of the refrigerant, which is extracted from the means for compressing may be extracted from the at least one compression chamber at a time at which the compression chamber is closed, but the compression has not yet started.

If the portion of the refrigerant is extracted before the compression starts or at an early stage of the compression, the extracted portion of the refrigerant has a relatively low temperature. In particular, the temperature of the extracted portion of the refrigerant may be equal to or slightly higher than the temperature the refrigerant has when it is received at the suction port of the compressor.

Because the temperature of the extracted portion of the refrigerant is, in general, lower than the temperature of the components of the compressor, the temperature of the extracted portion of the refrigerant is suitable for cooling the motor of the compressor. Thereby, the above-mentioned problem of heat generation in the compressor is addressed by providing cooling of the compressor. Furthermore, it may also be possible that other parts of the compressor, for example a lubricant reservoir, may also be cooled by the refrigerant. This may further improve the cooling of the compressor and solve the problem of heat generation in the compressor.

The cooling effect may be dependent on the amount of refrigerant, which is extracted from the at least one compression chamber. In a preferred embodiment, 5 to 50 volume percent of the amount of refrigerant, which is received by the at least one compression chamber, may be extracted via the opening.

In a preferred embodiment of the invention, the extracted portion of the refrigerant may not only be used for cooling the motor. In the event that the compressor comprises a lubricant reservoir configured for lubricating various parts of the compressor, the extracted portion of the refrigerant may additionally be supplied to the lubricant reservoir for cooling the lubricant. Preferably, the lubricant may be an oil.

The lubricant reservoir may comprise a sump, which is configured for collecting excess lubricant and may be used as a source for supplying the lubricant. Further, the lubricant reservoir may comprise a means for supplying the lubricant to other parts inside the compressor, for example, a pump. In another example, the lubricant reservoir may be configured to provide the lubricant to other parts inside the compressor passively, for example, by allowing another part of the compressor to take the lubricant from the lubricant reservoir. For example, a crankshaft, which may connect the motor to the means for compressing, may at least partially penetrate the lubricant sump and will be moistened by the lubricant.

In another preferred embodiment, the means for compressing may be a scroll set. In this case, the compressor may be referred to as scroll compressor. The scroll compressor comprises at least two scroll plates. In most common applications, two scroll plates are used.

In case of a scroll compressor, the at least one movable element of the means for compressing is formed by at least one of the scroll plates. For this purpose, the scroll plates are moved relatively to each other. This motion may be a periodic motion. For example, a first scroll plate of the two scroll plates may be a stationary scroll plate and a second scroll plate of the two scroll plates may be moved relatively to the stationary scroll plate. The second scroll plate may be moved in an eccentric orbit around the stationary scroll plate. In this case, the second scroll plate is moved without rotation relatively to the stationary scroll plate and the center of the orbit is not the same as the center of the stationary scroll plate. The second scroll plate is referred to as orbiting scroll plate in this case. In another example, it is also possible that the two scroll plates are moveable and are co-rotating in a synchronous motion but with offset centers of rotation.

The scroll plates of the scroll compressor each comprise a base plate and a spiral wrap. For example, the base plate may be disk-shaped and the spiral wrap may protrude on the surface on one side of the disk-shaped plate. Each spiral wrap defines an involute curve, which has the form of a spiral. In principle, various forms of spirals may be used. However, it is necessary that the spiral wraps of the two scroll plates are conjugate. Using conjugate spiral wraps allows stacking the scroll plates by interleaving their spiral wraps. In some embodiments, the spiral wraps may be symmetrical, but in some other embodiments, the spiral wraps may be asymmetrical. In case of symmetrical spirals, the spirals of the two scroll plates comprise a substantially similar curvature. In case of asymmetrical spirals, the spirals of the two scroll plates each comprise a different curvature. In an example, at least one of the spirals may be an Archimedean spiral.

The scroll set of the compressor is formed by stacking the disk-shaped scroll plates. Thereby, their conjugate spiral wraps are interleaved. Upon interleaving the spiral wraps of the respective scroll plates, the spiral wraps contact each other at several points along the flanks of the spirals as well as the opposing base plates. Thereby, the spiral wraps form one or more compression chambers. A compression chamber is a closed volume, which is surrounded by the flanks of the interleaved spiral wraps and the base plates. Hence, the compression chambers are separated volumes inside the spiral wraps. Their volume is limited by the flanks of the spiral wraps and the opposing base plates. Further, the volume of the compression chambers is changed during the compression by the relative motion of the scroll plates.

In a preferred embodiment, the one or more compression chambers are formed between the interleaved spiral wraps. During relative motion of the scroll plates, the compression chambers change their location and move radially from an outermost location between the interleaved spiral wraps to the center of the interleaved spiral wraps. Thereby, the compression chambers are generated at the radially outermost locations between the spiral wraps and are transformed, by ease of further relative motion of the scroll plates, to compression chambers, which are located at a radially inner location between the spiral wraps. The transformation of the outermost compression chambers to the inner compression chambers is continuous.

A compression chamber is formed at the outside of the spiral wraps when parts of the spiral depart from one another. In an example, at one point in time, the end of the involute curve of the spiral wrap of one of the two scroll plates is in contact with the involute curve of the spiral wrap of the second scroll plate. At a following point in time, the scroll plates move relatively with respect to each other, which causes the end of the involute curve of the first scroll plate to be moved away from the involute curve of the second scroll plate. Thereby, a space between the two involute curves is opened. This space is transformed into an outermost compression chamber upon the further motion of the scroll plates.

Once the outermost compression chamber is opened, refrigerant, which has been supplied from the suction port of the compressor, may flow into the outermost compression chamber until the compression chamber is closed by the further motion of the scroll plates, for example when the end of the involute curve of the first scroll plate is moved again towards the involute curve of the second scroll plate. For example, the outermost compression chamber may be closed when a full cycle of the periodic relative motion of the scroll plates is performed.

Once a compression chamber is closed, the compression chamber moves upon further relative motion of the scroll plates from a radially outer location between the spiral wraps radially inwards towards the center of the spiral wraps. Thereby, an outermost compression chamber is transformed into an inner compression chamber until the inner compression chamber reaches the outlet of the means for compressing, in this case the outlet of the scroll set. Usually, the outlet is located in the center of the interleaved spiral wraps. At the outlet, the refrigerant is ejected from the inner compression chamber and thereby from the scroll set towards the discharge port of the compressor.

The more the compression chamber is moved from a radially outer location of the spiral wraps to the center of the spiral wraps, the more the compression chamber will be transformed into a compression chamber with a smaller volume. Thereby, the portion of the refrigerant inside the compression chamber is compressed. This compression starts after the outermost compression chamber is closed and the compression is performed continuously until the outermost compression chamber is transformed into an inner compression chamber, which opens towards the outlet. Hence, the radially outermost compression chamber comprises refrigerant at the lowest temperature and pressure, which are substantially similar to the suction temperature and suction pressure, whereas the radially innermost compression chamber comprises refrigerant at the highest temperature and pressure.

In case of a scroll compressor, the extracted portion of the refrigerant is extracted from one of the compression chambers, which are formed by the scroll set. In at least some embodiments, the portion of the refrigerant is extracted from a compression chamber, which is located at a radially outer location between the spiral wraps. In this case, at least one of the scroll plates comprises at least one opening, which is configured for extracting the portion of the refrigerant and which is arranged on the scroll plate in such a way that it is in fluid communication with the radially outer compression chamber at least for a period of time. At this time, the relative motion of the scroll plates will pump a portion of the refrigerant through the opening, whereby the portion of the refrigerant will be extracted from the scroll set. In at least some embodiments, the opening is in fluid communication with the outermost compression chamber right after the relative motion of the scroll plates has closed the outermost compression chamber. In this case, the refrigerant inside the outermost compression chamber has not yet been substantially compressed by the transfer of the outermost compression chamber to an inner compression chamber. Therefore, the extracted portion of the refrigerant will have a relatively low temperature compared to the discharge temperature. In particular, the temperature of the extracted portion of the refrigerant may be similar to the temperature of the refrigerant upon reception at the suction port of the compressor.

Since the extraction of the portion of the refrigerant is actuated by the relative motion of the scroll plates, there is no need for additional components, like pumps.

In another preferred embodiment, the compressor comprises a low pressure side and a high pressure side, wherein the discharge port is arranged at the high pressure side and the suction port and the motor are arranged at the low pressure side. Further, a transition area between the low pressure side and the high pressure side is formed by the means for compressing. In case that the compressor comprises a lubricant reservoir, the lubricant reservoir may also be arranged at the low pressure side. This compressor configuration allows to keep the motor and the optional lubricant reservoir at a low pressure substantially similar to the suction pressure. Since the extracted portion of the refrigerant is extracted from the means for compressing and supplied to the motor at the low pressure side, the cooling is also performed at a pressure substantially similar to the low pressure side pressure. Hence, there is no need for pressured piping and no leakage needs to be taken care of.

Further, the compressor may comprise at least one tube, which is disposed between the opening configured for extracting a portion of the refrigerant and the low pressure side. The tube may be in fluid communication with the opening and ends in the low pressure side, preferably below the motor. Further, the tube may be configured for piping the extracted portion of the refrigerant from the at least one compression chamber formed by the means for compressing to the low pressure side and for distributing the extracted portion of the refrigerant in a proximity to the motor. Thereby, the extracted portion of the refrigerant may be distributed in the low pressure side in the proximity to the motor in order to achieve a substantially homogeneous cooling of the motor. Further, the tube may comprise multiple outlets, which may allow for a targeted distribution of the extracted portion of the refrigerant in the proximity of the compressor. The at least one tube may be arranged entirely inside the housing of the compressor or at least a portion of the tube may also be external to the housing of the compressor.

After the extracted portion of the refrigerant has been used to cool the motor, the refrigerant may flow back to the means for compressing. This may be achieved by a suitable arrangement of the components inside the compressor, for example if the means for compressing is disposed above the motor. Then the cool extracted portion of the refrigerant will exchange heat with the motor and will heat up during this process. In this case, the warmer extracted portion of the refrigerant will rise towards the location of the compression and may be drawn into the means for compressing, for example by a motion of the movable elements.

Furthermore, the above-mentioned need is also fulfilled by a method according to the invention. The method according to the invention is performed by a compressor and comprises receiving a refrigerant at a suction port of the compressor, compressing the refrigerant in at least one compression chamber, which is formed by a means for compressing of the compressor, and discharging the refrigerant from the compressor at a discharge port of the compressor. After reception of the refrigerant at the suction port of the compressor and prior to compressing the refrigerant, the refrigerant may be received at an inlet of the means for compressing. Further, after compressing the refrigerant and prior to discharging the compressed refrigerant, the compressed refrigerant may be ejected from the means for compressing via an outlet of the means for compressing.

According to the present invention, the method comprises extracting a portion of the refrigerant from the at least one compression chamber formed by the means for compressing and supplying the extracted portion of the refrigerant to a motor of the compressor.

In a preferred embodiment, the portion of the refrigerant is extracted from the at least one compression chamber formed by the means for compressing before the refrigerant is compressed. This allows for supplying the extracted portion of the refrigerant to the motor at a low temperature, because the extracted portion of the refrigerant has not been heated during a compression process.

The following description and the annexed drawings set forth in detail certain illustrative aspects of the apparatus and the method described above. These aspects are indicative, however, of but a few of the various ways in which the principles of various embodiments can be employed and the described embodiments are intended to include all such aspects and their equivalent. In particular, it needs to be highlighted that—although the following drawings only show embodiment examples of scroll compressors—the invention may be applied to any type of compressor, which comprises a means for compressing with at least one moving element.

In the drawings, like reference characters generally refer to the same parts throughout the different drawings. The drawings are not necessarily to scale, emphasis instead generally being placed upon illustrating the principles of the invention.

DRAWINGS

In the following description, various embodiments of the invention are described with reference to the following drawings, in which:

FIG. 1 shows a cross-sectional view of an embodiment of a compressor according to the invention.

Figure 2A:
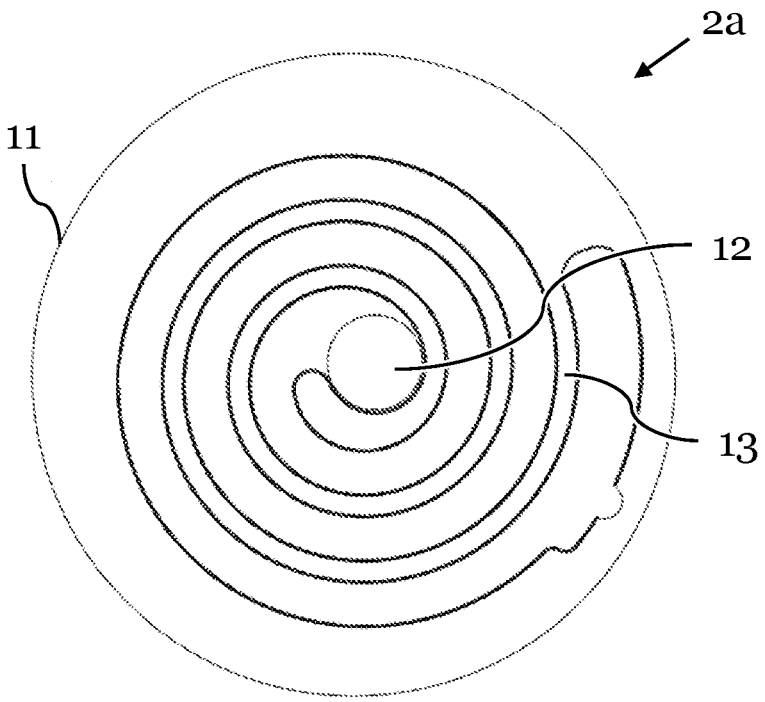
Figure 2B:
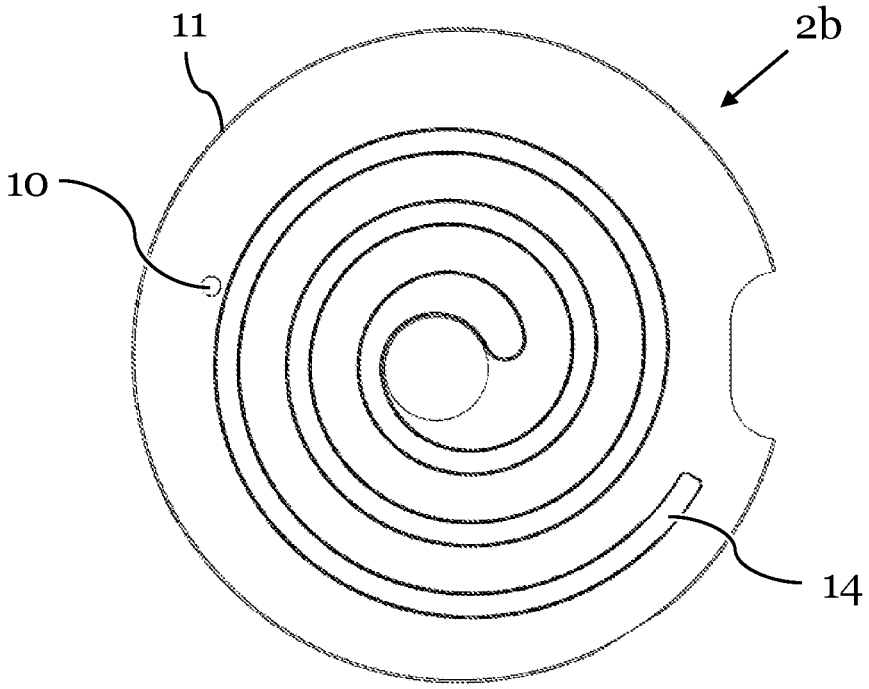

FIGS. 2*a* and 2*b* show cross-sectional views of exemplary scroll plates of a compressor according to the invention.

Figure 3:
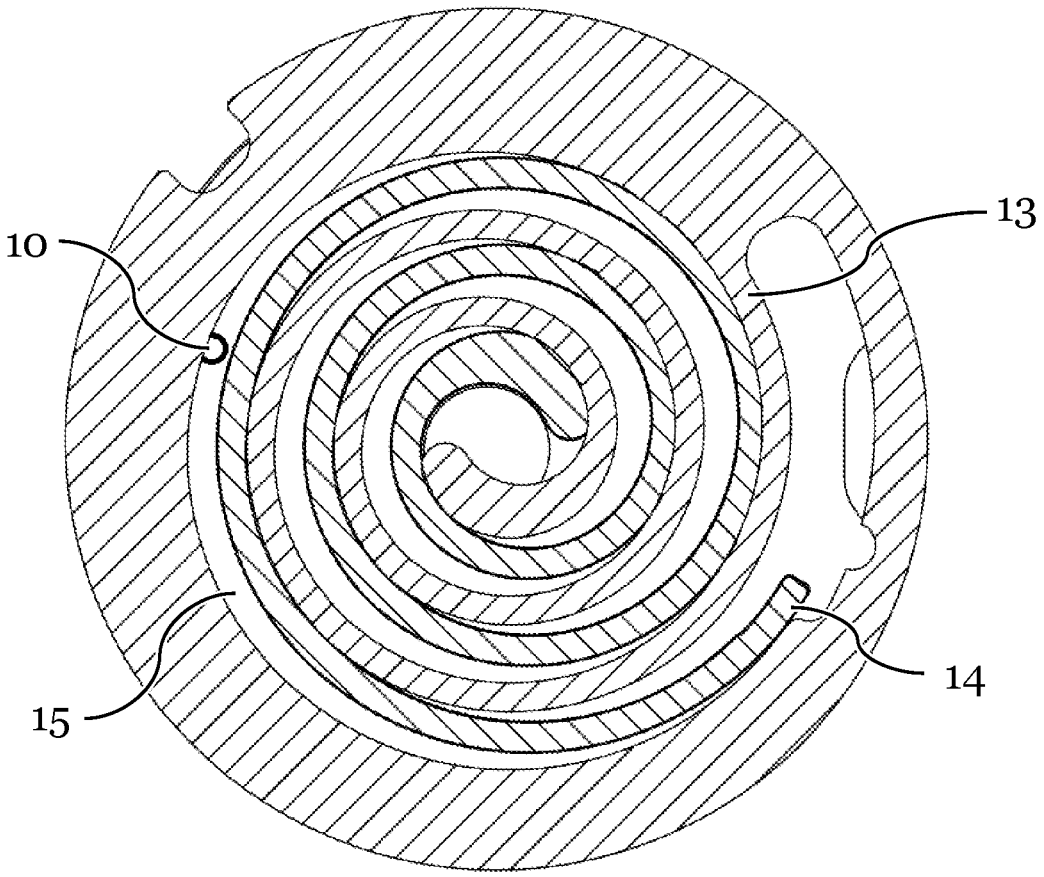

FIG. 3 shows a cross-sectional view of interleaved scroll plates, which form a scroll set and multiple compression chambers.

FIGS. 4*a*-4*d* show cross-sectional views of the interleaved scroll plates of FIG. 3, wherein the FIGS. 4*a*-4*d* show the transformation of an exemplary compression chamber through different time instances.

Figure 5:
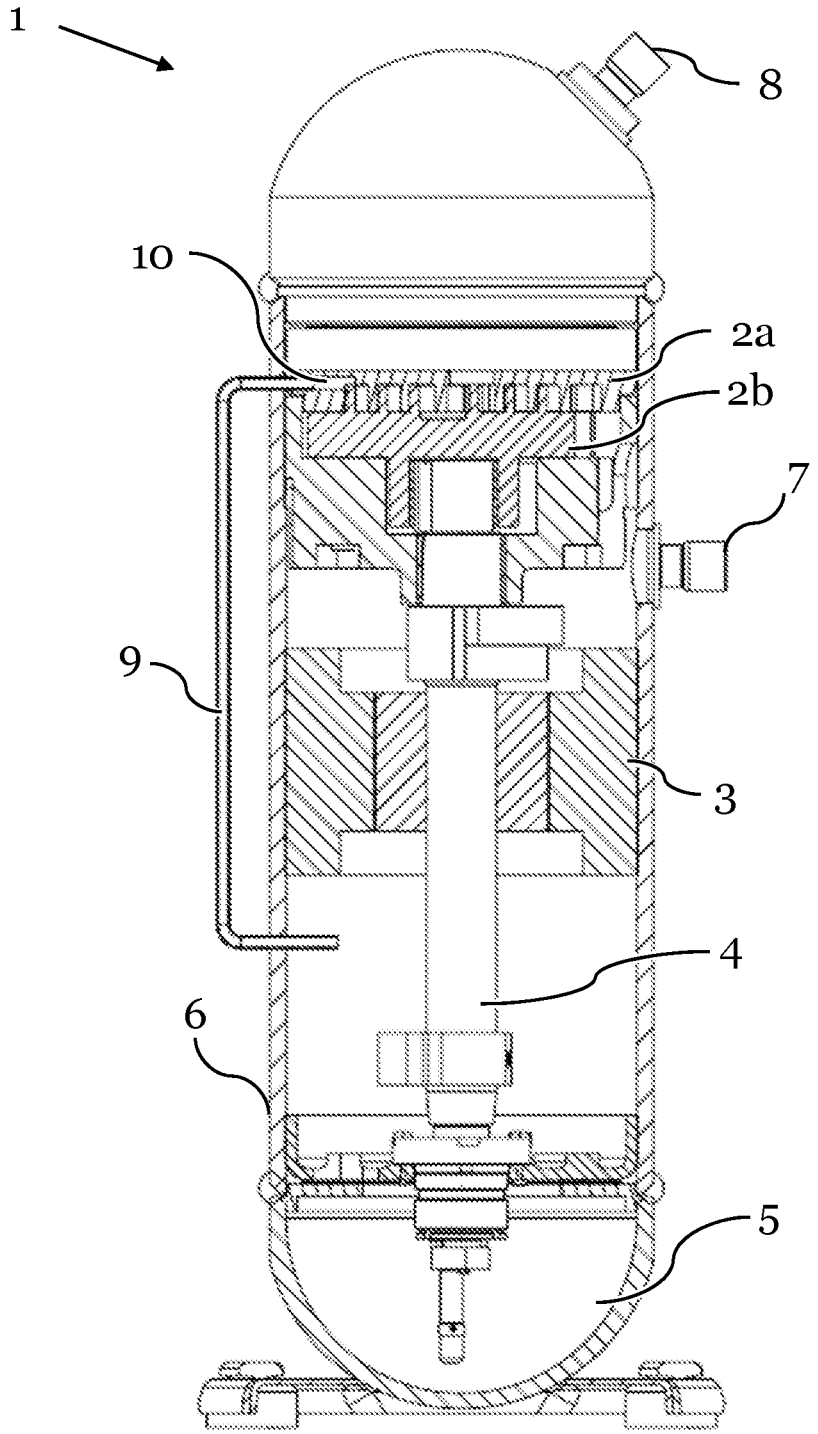

FIG. 5 shows a cross-sectional view of another embodiment of a compressor according to the invention.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration." Any embodiment or design described herein as "exemplary" is not necessarily to be construed as preferred or advantageous over other embodiments or designs.

FIG. 1 shows a cross-sectional view of an embodiment of a compressor 1 according to the invention. The compressor 1 comprises a suction port 7 for receiving a refrigerant and a discharge port 8 for discharging the refrigerant from the compressor 1.

The compressor design, which is depicted in FIG. 1, comprises a high pressure side and a low pressure side. The low pressure side comprises the suction port 7 and receives the refrigerant at a low temperature and a low pressure. The high pressure side comprises the discharge port 8 and receives the compressed refrigerant from the low pressure side and discharges said portion of the compressed refrigerant from the compressor 1. The low pressure side and the high pressure side are connected to each other via a means for compressing.

The compressor design, which is depicted in FIG. 1, is a scroll compressor. In this design, the means for compressing is formed by a scroll set 2*a*, 2*b*. The scroll set 2*a*, 2*b* comprises a first scroll plate 2*a*, which is a stationary scroll plate in this example, and a second scroll plate 2*b*, which is an orbiting scroll plate in this example. In the particular example depicted in FIG. 1, the stationary scroll plate 2*a* and the orbiting scroll plate 2*b* each comprise a spiral wrap and a base plate. Further, the stationary scroll plate 2*a* and the orbiting scroll plate 2*b* are arranged in such a way that the sides of the scroll plates 2*a*, 2*b*, which comprise the spiral wraps, face each other. Further, the spiral wraps are interleaved. By interleaving the spiral wraps, the scroll plates 2*a*, 2*b* form one or more compression chambers, which are configured for compressing the refrigerant.

The orbiting scroll plate 2*b* is configured to change the volumes of the compression chambers by a motion relative to the stationary scroll plate 2*a*. In this regard, the orbiting scroll plate 2*b*, the stationary scroll plate 2*a* and their relative arrangement are configured to compress the refrigerant.

The motion of the orbiting scroll plate 2*b* is actuated by the motor 3 of the compressor 1. The motor 3 is located in the low pressure side of the compressor 1 and is connected to the orbiting scroll plate 2*b* by ease of a crank shaft 4 and a coupling. Further, the compressor 1 comprises a lubricant reservoir 5, which is used for lubricating the crankshaft 4, the coupling, the motor 3, and the scroll set 2*a*, 2*b*. The lubricant reservoir is also located at the low pressure side.

By adding an opening 10 to either the stationary scroll plate 2*a* or the orbiting scroll plate 2*b*, a portion of the refrigerant is extracted from one of the compression chambers via the opening 10. In this case, the motion of the orbiting scroll plate 2*b* may pump a portion of the refrigerant through the opening 10 to the motor 3.

The opening 10 is in fluid communication with a tube 9 and the extracted portion of the refrigerant may be piped to the motor via the tube 9. As depicted in FIG. 1, the tube 9 ends below the motor 3 and the extracted portion of the refrigerant will diffuse in the low pressure side of the compressor 1. Thereby, the extracted portion of the refrigerant will reach the motor 3 and the lubricant reservoir 5 and will cool these components.

During the cooling of the components in the low pressure side of the compressor 1, the extracted portion of the refrigerant will accept heat from said components. Thereby, the extracted portion of the refrigerant will heat up and will come back to the scroll set 2*a*, 2*b*. Once the extracted portion of the refrigerant reaches the scroll set 2*a*, 2*b*, the extracted portion of the refrigerant may be received from the means for compressing, for example caused by a suction caused by the motion of the orbiting scroll plate 2*b*.

With respect to the compressor 1 depicted in FIG. 1, the person skilled in the art will appreciate that the refrigerant, when it is received by the compressor 1 at its suction port 7, will not evenly cool the components in the low pressure side of the compressor 1. Because the refrigerant has a low temperature and the motor 3 has a high temperature during operation, the refrigerant may be in more contact with the upper part of the motor 3, and in less contact with the lower part of the motor 3. This raises a need for cooling the motor 3 more evenly, which is addressed by the motor cooling according to the invention.

FIGS. 2*a*, 2*b* show cross-sectional views of exemplary scroll plates 2*a*, 2*b* of a compressor 1 according to an embodiment of the invention.

The scroll plate 2*a* depicted in FIG. 2*a* is an example of a stationary scroll plate. The stationary scroll plate 2*a* comprises a base plate 11 and a spiral wrap 13, which is used to form a series of compression chambers upon interleaving with a corresponding spiral wrap of another scroll plate. At the center of the spiral wrap 13, the scroll plate 2*a* comprises an outlet 12. This outlet 12 may either correspond to the outlet of the means for compressing or may be in fluid connection with the outlet of the means for compressing.

The scroll plate 2*b* depicted in FIG. 2*b* is an example of an orbiting scroll plate. The orbiting scroll plate 2*b* comprises a base plate 11 and a spiral wrap 14, which is used to form a series of compression chambers upon interleaving with a corresponding spiral wrap of another scroll plate, for example spiral wrap 13 of the stationary scroll plate 2*a*. Further, the orbiting scroll plate 2*b* comprises an opening 10, which is arranged at the base plate 11. The opening 10 is arranged at the base plate 11 in such a way that the opening 10 will be in fluid communication with at least one of the compression chambers for at least a portion of time, when the orbiting scroll plate 2*b* is interleaved with a corresponding stationary scroll plate 2*a*. An example of a preferred location of the opening 10 on the base plate 11 is depicted in FIG. 3.

FIG. 3 shows a cross-sectional view of interleaved scroll plates, which form a scroll set and multiple compression chambers. The example depicted in FIG. 3 shows a stationary scroll plate 2*a* as depicted in FIG. 2*a* on top of an orbiting scroll plate 2*b* as depicted in FIG. 2*b*. The interleaved spiral wraps 13, 14 engage each other at different locations and form compression chambers 15 in the spaces between the spiral wraps 13, 14. The location and the volume of the compression chambers 15 changes upon motion of the orbiting scroll plate 2*b*, when the outermost compression chamber 15 will be transformed into an inner compression chamber.

In the time instance depicted in FIG. 3, the compression chamber 15 is formed at a radially outer location of the spiral wraps 13, 14. Further, compression chamber 15 is closed because the radially outermost end of the spiral wrap 14 of the orbiting scroll plate 2*b* engages the spiral wrap 14 of the stationary scroll plate 2*a*. At this time instance, the opening 10 engages the edge of the compression chamber 15, such that the opening 10 and the compression chamber 15 are in direct fluid communication. Upon further motion of the orbiting scroll plate 2*b*, the compression chamber 15 will be moved along the course dictated by the involute curve of the spiral wraps 13, 14. Thereby, the volume of the compression chamber 15 will be reduced and the refrigerant inside the compression chamber 15 will be compressed. Additionally, as long as the opening 10 is in direct fluid communication with the compression chamber 15, the refrigerant will only slightly be compressed, because a portion of the refrigerant will be pumped through the opening 10 in order to avoid an increase in pressure caused by a reduction in the volume of the compression chamber 15. Thereby, a portion of the refrigerant will be extracted from the compression chamber 15.

FIGS. 4*a* to 4*d* show cross-sectional views of the interleaved scroll plates of FIG. 3, wherein the FIGS. 4*a* to 4*d* show the transformation of an exemplary compression chamber through different time instances.

Figure 4A:
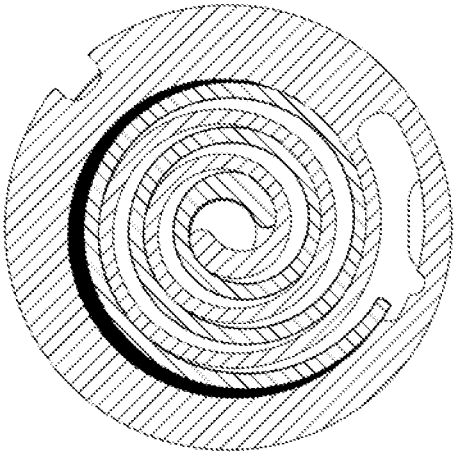

FIG. 4*a* shows a first time instance t=0. This time instance corresponds to the time instance depicted in FIG. 3. Compression chamber 15 as depicted in FIG. 3 is highlighted as black space in FIG. 4*a*.

Figure 4B:
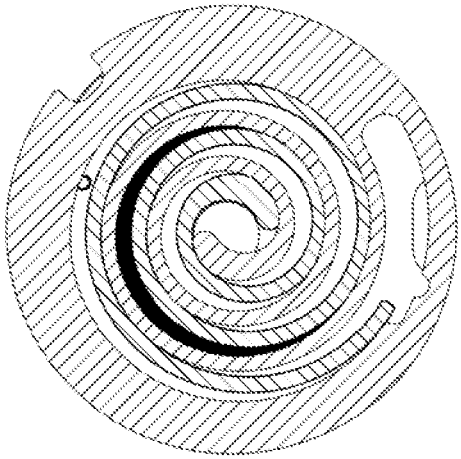
Figure 4C:
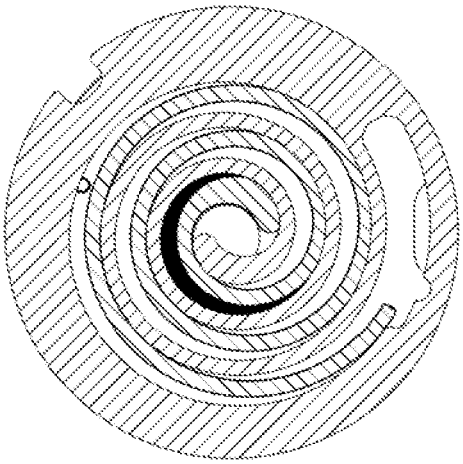
Figure 4D:
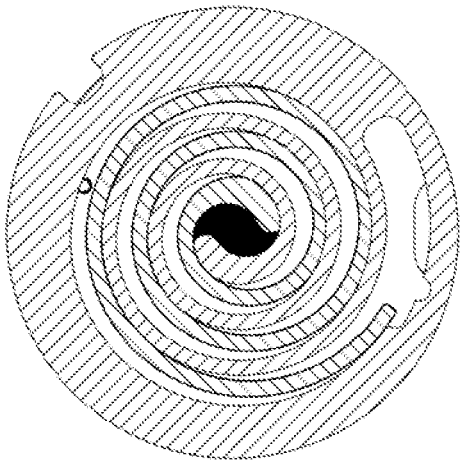

FIG. 4*b* shows the situation at the time instance t=T, which means after the orbiting scroll 2*b* performs one complete cycle of its periodic motion with the cycle duration T. Compression chamber 15, which was initially located at a radially outer location of the spiral wraps 13, 14, has now been transformed to an inner compression chamber with a reduced volume. After a further motion cycle of the orbiting scroll plate 2*b*, the FIG. 4*c* shows the situation at the time instance t=2T. The compression chamber is again moved further along the course dictated by the spiral wraps 13, 14 and is transformed into a compression chamber the volume of which is even further reduced. After a third motion cycle, the compression chamber has been even more compressed and reached the center of the spiral wraps 13, 14, which is also the location of the outlet of the scroll set, from where the refrigerant will be provided to the discharge port 8. This time instance is shown in FIG. 4*d* at the time t=3T.

FIG. 5 shows a cross-sectional view of another embodiment of a compressor according to the invention.

The embodiment example depicted in FIG. 5 differs from the embodiment example depicted in FIG. 1 in that the opening 10 for extracting the portion of the refrigerant is located in the stationary scroll plate 2*a* instead of the orbiting scroll plate 2*b* as depicted in FIG. 1. The person skilled in the art will appreciate that this difference may not change the operation of the cooling but only has an effect on the course of the tube 9, which is used for supplying the extracted portion of the refrigerant to the motor 3 and/or the lubricant reservoir 5. Furthermore, although not shown in the drawings, it would also be possible that the stationary scroll plate 2*a* and the orbiting scroll plate 2*b* each comprise at least one opening 10. In such a case, the operation of the cooling itself is not different to the examples shown, but the amount of extracted refrigerant and the number of tubes 9 may increase.

In the embodiment example depicted in FIG. 5, the tube 9 is located at least partially outside of the casing 6 of the compressor 1. Thereby, the tube 9 may pass the orbiting scroll plate 2*b* without encountering the orbiting scroll plate 2*b*. This allows to save space inside the casing 6 because the entire cross-section of the casing 6 is available for the motion of the orbiting scroll plate 2*b*. However, it may also be possible that the tube 9 is located entirely within the casing 6 of the compressor 1 when the opening 10 is in the stationary scroll plate 2*a*. In this case, the tube 9 would pass the orbiting scroll plate 2*b* within the casing 6 and reduce the space, which is available for the motion of the orbiting scroll plate 2*b*.

Furthermore, the embodiment example depicted in FIG. 5 differs from the embodiment example depicted in FIG. 1 in that the outlet of the tube 9 in the low pressure side of the compressor 1 is oriented horizontally. The person skilled in the art will appreciate that this is merely a design aspect and does not substantially affect the operation of the motor cooling. This is because the motion of the orbiting scroll 2*b* pumps the extracted portion of the refrigerant through the tube 9, such that the extracted portion of the refrigerant will be ejected from the tube 9 in the low pressure side at a pressure, which may be slightly higher than the pressure of the low pressure side.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the scope of the appended claims.

What is claimed is:

1. A compressor for compressing a refrigerant comprising:

a suction port configured to receive the refrigerant at the compressor;

a means for compressing the refrigerant, wherein the means for compressing forms at least one compression chamber;

a discharge port configured for discharging the compressed refrigerant from the compressor; and a motor;

wherein the means for compressing comprises at least one opening for extracting a portion of the refrigerant from the at least one compression chamber and supplying the extracted portion of the refrigerant to the motor, wherein the compressor further comprises:

a low pressure side and a high pressure side, wherein the discharge port is arranged at the high pressure side of the compressor and the suction port and the motor are arranged at the low pressure side, and wherein a transition area between the low pressure side and the high pressure side is formed by the means for compressing; and at least one tube, wherein the tube is in fluid communication with the opening and ends in the low pressure side below the motor, thereby being configured for piping the extracted portion of the refrigerant from the at least one compression chamber to the low pressure side and for distributing the extracted portion of the refrigerant in a proximity to the motor.

2. The compressor of claim 1, wherein the means for compressing is a scroll set, which is configured for compressing the refrigerant.

3. The compressor of claim 2, wherein the scroll set comprises two scroll plates and wherein at least one scroll plate performs a motion relatively to the other scroll plate.

4. The compressor of claim 3, wherein each scroll plate comprises a spiral wrap and wherein the two scroll plates are arranged such that the spiral wraps are interleaved and form at least one compression chamber.

5. The compressor of claim 4, wherein the spiral wraps of the scroll plates are symmetric to one another.

6. The compressor of claim 4, wherein the spiral wraps of the scroll plates are asymmetric to one another.

7. The compressor of claim 3, wherein one of the two scroll plates comprises the at least one opening for extracting the portion of the refrigerant.

8. The compressor of claim 3, wherein the means for compressing comprises at least two openings and wherein each scroll plate comprises at least one opening for extracting the portion of the refrigerant.

9. The compressor of claim 1, further comprising a lubricant reservoir, and wherein the tube is further configured for supplying at least a portion of the extracted portion of the refrigerant to a proximity of the lubricant reservoir.

10. The compressor of claim 1, wherein 5 to 50 percent of the amount of refrigerant, which is received by the means for compressing, is extracted via the opening.

11. A method for compressing a refrigerant, the method being performed by a compressor, comprising:

receiving a refrigerant at a suction port of the compressor;

compressing the refrigerant in at least one compression chamber, which is formed by a means for compressing of the compressor;

discharging the refrigerant from the compressor at a discharge port of the compressor; and extracting a portion of the refrigerant from the at least one compression chamber formed by the means for compressing and supplying the extracted portion of the refrigerant to a motor of the compressor, wherein the compressor further comprises:

a low pressure side and a high pressure side, wherein the discharge port is arranged at the high pressure side of the compressor and the suction port and the motor are arranged at the low pressure side, and wherein a transition area between the low pressure side and the high pressure side is formed by the means for compressing; and at least one tube, wherein the tube is in fluid communication with the opening and ends in the low pressure side below the motor, thereby being configured for piping the extracted portion of the refrigerant from the at least one compression chamber to the low pressure side and for distributing the extracted portion of the refrigerant in a proximity to the motor.

12. The method of claim 11, wherein the portion of the refrigerant is extracted from the at least one compression chamber formed by the means for compressing before the refrigerant is compressed.

13. The method of claim 11, wherein the compressor further comprises a lubricant reservoir and wherein the method further comprises supplying at least a portion of the extracted portion of the refrigerant to the lubricant reservoir.

14. A compressor for compressing a refrigerant comprising:

a suction port configured to receive the refrigerant at the compressor;

a means for compressing the refrigerant, wherein the means for compressing forms at least one compression chamber;

a discharge port configured for discharging the compressed refrigerant from the compressor; and a motor;

wherein the means for compressing comprises at least one opening for extracting a portion of the refrigerant from the at least one compression chamber and supplying the extracted portion of the refrigerant to the motor, wherein the means for compressing is a scroll set, which is configured for compressing the refrigerant, wherein the scroll set comprises two scroll plates and wherein at least one scroll plate performs a motion relatively to the other scroll plate, and wherein the means for compressing comprises at least two openings and wherein each scroll plate comprises at least one opening for extracting the portion of the refrigerant.

15. The compressor of claim 14, wherein each scroll plate comprises a spiral wrap and wherein the two scroll plates are arranged such that the spiral wraps are interleaved and form at least one compression chamber.

16. The compressor of claim 15, wherein the spiral wraps of the scroll plates are symmetric to one another.

17. The compressor of claim 15, wherein the spiral wraps of the scroll plates are asymmetric to one another.

18. The compressor of claim 14, further comprising:

a low pressure side and a high pressure side, wherein the discharge port is arranged at the high pressure side of the compressor and the suction port and the motor are arranged at the low pressure side, wherein a transition area between the low pressure side and the high pressure side is formed by the means for compressing.

19. The compressor of claim 18, further comprising:

at least one tube, wherein the tube is in fluid communication with the opening and ends in the low pressure side below the motor, thereby being configured for piping the extracted portion of the refrigerant from the at least one compression chamber to the low pressure side and for distributing the extracted portion of the refrigerant in a proximity to the motor; and a lubricant reservoir, and wherein the tube is further configured for supplying at least a portion of the extracted portion of the refrigerant to a proximity of the lubricant reservoir.

20. The compressor of claim 14, wherein 5 to 50 percent of the amount of refrigerant, which is received by the means for compressing, is extracted via the opening.

* * * * *